US011805824B2

(12) United States Patent
Vanneste

(10) Patent No.: US 11,805,824 B2
(45) Date of Patent: Nov. 7, 2023

(54) ACTIVE BREATHING SYSTEM

(71) Applicant: BEMICRON, Charleroi (BE)

(72) Inventor: Vincent Vanneste, Thimougies (BE)

(73) Assignee: BEMICRON, Charleroi (BE)

( * ) Notice: Subject to any disclaimer, the term of this patent is extended or adjusted under 35 U.S.C. 154(b) by 516 days.

(21) Appl. No.: 16/768,034

(22) PCT Filed: Dec. 14, 2018

(86) PCT No.: PCT/EP2018/084947
§ 371 (c)(1),
(2) Date: May 28, 2020

(87) PCT Pub. No.: WO2019/115763
PCT Pub. Date: Jun. 20, 2019

(65) Prior Publication Data

US 2020/0359714 A1 Nov. 19, 2020

(30) Foreign Application Priority Data

Dec. 15, 2017 (BE) ..... 2017/5947
Aug. 27, 2018 (BE) ..... 2018/5590

(51) Int. Cl.
*A41D 13/002* (2006.01)
*A41D 13/02* (2006.01)
(Continued)

(52) U.S. Cl.
CPC ..... *A41D 13/0025* (2013.01); *A41D 13/02* (2013.01); *A62B 7/10* (2013.01); *A62B 9/04* (2013.01); *A62B 17/006* (2013.01); *A62B 23/02* (2013.01); *F24F 2221/38* (2013.01)

(58) Field of Classification Search
CPC .. A41D 13/0025; A41D 13/002; A41D 13/02; A41D 13/11; A62B 7/10;
(Continued)

(56) References Cited

U.S. PATENT DOCUMENTS 3,525,334 A * 8/1970 Braman ..... A41D 13/0025 2/81
4,649,715 A 3/1987 Barker
(Continued)

FOREIGN PATENT DOCUMENTS

DE 102010038120 A1 * 4/2012 ..... A41D 13/0015
GB 2523049 A 8/2015
JP 2016033267 A 7/2014

OTHER PUBLICATIONS

English Machine Translation of DE-102010038120-A1 provided by PE2E (Year: 2012).*
(Continued)

*Primary Examiner* — Joseph D. Boecker
*Assistant Examiner* — Brian T Khong
(74) *Attorney, Agent, or Firm* — Merchant & Gould P.C.

(57) ABSTRACT

An active breathing system is for an aseptic overalls arranged to be worn by a user. The system includes an aeration device and a surrounding air inlet, and aseptic overalls for a cleanroom. The aeration device includes a first longitudinal hollow body arranged to receive a ventilator connected to an energy source, an air suctioning tube in fluidic communication with the longitudinal hollow body, and the surrounding air outlet in fluidic communication with the longitudinal hollow body, and arranged to direct surrounding air upwards. The aeration device has an air inlet on the aseptic overalls and arranged to enable passage of the surrounding air on the outside of the aseptic overalls in an inner portion of the aseptic overalls.

17 Claims, 10 Drawing Sheets

(51) Int. Cl.

| | |
|---|---|
| ***A62B 7/10*** | (2006.01) |
| ***A62B 9/04*** | (2006.01) |
| ***A62B 17/00*** | (2006.01) |
| ***A62B 23/02*** | (2006.01) |

(58) Field of Classification Search
CPC ..... A62B 7/02; A62B 7/12; A62B 17/006; A62B 17/04; A62B 17/005; A62B 17/008; A62B 18/003; A62B 18/006; A62B 9/04; A62B 23/02; F24F 2221/38
See application file for complete search history.

(56) References Cited

U.S. PATENT DOCUMENTS

| | | | | |
|---|---|---|---|---|
| 2003/0154983 | A1* | 8/2003 | Marx | A62B 18/006 128/206.13 |
| 2004/0226558 | A1* | 11/2004 | Kausch | A62B 17/005 128/201.29 |
| 2015/0297920 | A1* | 10/2015 | Takeuchi | A62B 18/006 2/455 |
| 2017/0259089 | A1* | 9/2017 | De Jesus | A61F 9/068 |

OTHER PUBLICATIONS

Written Opinion from International Application No. PCT/EP2018/084947, dated Mar. 11, 2019.
International Search Report from International Application No. PCT/EP2018/084947, dated Mar. 11, 2019.

* cited by examiner

ACTIVE BREATHING SYSTEM

This application is a National Stage Application of International Application No. PCT/EP2018/084947, filed Dec. 14, 2018, which claims benefit of Ser. No. 2018/5590, filed Aug. 27, 2018 in Belgium and Ser. No. 2017/5947, filed Dec. 15, 2017 in Belgium, and which applications are incorporated herein by reference. To the extent appropriate, a claim of priority is made to each of the above-disclosed applications.

The present invention relates to an active breathing system for aseptic overalls arranged to be worn by a user.

This system type is commonly used in cleanrooms. More specifically, the user puts on aseptic overalls and must be able to have an exchange with the surrounding environment in order to be able to breathe, while guaranteeing a sterile environment during handling carried out in a cleanroom. Indeed, a more and more frequent problem, with the improvement applied to textile materials, is that operators suffer from disadvantages linked to an increase in the concentration of $CO_2$ even inside the overalls. There are portable aeration devices integrated in the overalls, but the constraints linked to handling or cleaning difficulties, even from time to time, sterilization makes them fragile, complexifying the logistics. Often, the airflows are academic, and ultimately, even used according to the criteria of the manufacturers, air is brought very variably, even not at all.

There are also diving overalls type systems, but also, the implementation is difficult and the handling is complicated.

It is therefore known to use a ventilation/aeration device which consists, using a ventilator, to orient the air inside the overalls worn by the user. This type of device is generally complex and expensive. In addition, the aeration device is heavy, which requires a fixed placement in a cleanroom.

Unfortunately, current devices have an imposing size which is constraining for the user who must be able to use this active breathing system by handling in a cleanroom.

Document U.S. Pat. No. 3,525,334 describes a set of clothes for a cleanroom comprising a jacket, a pair of trousers, a helmet, an air inlet means, a portable ventilator, and less imposing.

Knowing that the clothes used in a cleanroom must be aseptic, they cannot be contaminated during the wearing process, nor even in use. However, the wearing process is made complicated by the fixing means system which seals the jacket with the trousers.

According to this document, the aeration device is not located inside clothes for a cleanroom which represents a risk of contamination. The invention aims to overcome the disadvantages of the state of the art by providing an active breathing system for aseptic overalls which is simpler, less expensive, more ergonomic for the user while preserving the sterile environment of a cleanroom and the logistical conditions which are linked to it.

To resolve this problem, it is provided according to the invention, an active breathing system for aseptic overalls arranged to be worn by a user comprising:

- an aeration device for making it possible for an orientation of the surrounding air of a cleanroom external to said aseptic overalls in an internal portion of said aseptic overalls, said aeration device being arranged to be located inside said aseptic overalls and comprises
  - a first longitudinal hollow body arranged to receive a ventilator which is arranged to be connected to an energy source,
  - a surrounding air suctioning tube in fluidic communication with said longitudinal hollow body
  - a surrounding air outlet, also in fluidic communication with said longitudinal hollow body, and arranged to direct the surrounding air upwards,
- an air inlet means arranged to be situated on aseptic overalls and arranged to make it possible for the passage of the surrounding air outside of said overalls to the inside of said overalls, said air inlet means making it possible to provide said air suctioning tube surrounding said aeration device.

Thus, the device of the active breathing system is portable and smaller with respect to the state of the art and its logistics is facilitated. Indeed, only the air inlet means is in contact with the sterile external environment of the cleanroom while the aeration device is worn by the user, in the aseptic overalls, and although needing to be clean, it itself does not require to satisfy the drastic conditions of an aseptic environment. The air inlet means could furthermore be, a grid, a membrane, a permeable elastic wall, possibly equipped with an orifice, situated on the overalls making it possible for the suctioning of the surrounding air inside the overalls.

Thus, this makes it possible to provide an active breathing system, portable and simple to use, of which the air inlet means is located outside of the overalls in the environment surrounding the cleanroom and of which the aeration device as it is located inside the overalls of the user.

Indeed, the active breathing system according to the present invention is particularly advantageous as it provides an aeration device isolated by the overalls of the user of the sterile external environment of the cleanroom such that the active breathing system according to the present invention makes it possible to reduce the handling steps of the prior art such as the sterilization of the device or of the ventilator.

The system according to the invention can thus be integrated to a overalls for a cleanroom, which makes it possible to easily ensure an active breathing for the user who can do their handling by wearing the ventilator comfortably.

By the term "ventilator", this means in the sense of the present invention, a turbine equipped with blades rotating about an axis arranged to suction air through said surrounding air suctioning tube and making it exit through said proximal end of the air outlet surrounding the first longitudinal hollow body. The turbine rotates by activation of a switch, for example a mechanical or electronic switch and receive energy from the energy source to which it is connected, preferably the first longitudinal hollow body has a central longitudinal axis which is aligned to the axis of rotation of said turbine.

The turbine is advantageously sized and moved by a rotation speed to move and orient upwards, a substantially identical airflow, better slightly less than the airflow capable of passing through said at least one orifice, possibly equipped with a filtering membrane in order to make it possible for a stable and homogenous suctioning, providing comfort in use without overworking the engine of the turbine to avoid overheating and an increase in temperature in the overalls, all the more so as that is located in a hollow body, certainly ventilated, but small.

Even more, the active breathing system according to the present invention orients the surrounding airflow upwards and makes it possible to provide an airflow which is comfortable for the user, i.e. which does not drain their mucous membranes, without disturbing the sensitive atmosphere of the cleanroom. Furthermore, the system according to the present invention ensures a good balance in the airflow entering into the interface and the airflow exiting from the aeration device, in the overalls.

Advantageously, the active breathing system according to the present invention comprises a first air suctioning device comprising a main wall arranged to be situated outside of said aseptic overalls, from which a tube extends, preferably lateral, arranged to extend through the aseptic overalls to the inside of it and to be connected to said surrounding air suctioning tube reversibly, said main wall having at least one orifice, possibly equipped with a filtering membrane, arranged to make it possible for the passage of surrounding air external to said overalls, in said lateral tube in the direction from the inside of said overalls, by sequential passage in said surrounding air suctioning tube, in said first longitudinal hollow body and through said surrounding air outlet.

The system according to the invention is particularly simple, given that all that is needed, is to connect the tube, preferably laterally, of the first air suctioning interface to the surrounding air suctioning tube of the first longitudinal hollow body of the aeration device, for example, by forced interlocking or by crimping to ensure an air exchange with the outside and to connect the elements of the active breathing system for the aseptic overalls worn by a user, preferably, the aeration device is located in a body portion such as in a torso, leg, or buttock or even pelvis area portion.

Preferably, said surrounding air outlet is arranged to be connected at a first end to at least one means for directing the surrounding air in a torso area, preferably in a thorax area, in any case, in an under-head area in said overalls.

The system according to the present invention therefore comprises at least one means for directing the surrounding air, where said surrounding air outlet of the aeration device is connected to a first end of at least one means for directing the surrounding air in a torso area, preferably in a thorax area, in any case in an under-head area in said overalls.

This makes it possible for the conveyance of the surrounding air laterally extracted, directed upwards, to the desired area of the user, preferably in a torso area, in a thorax area, in any case in an under-head area of the overalls making it possible for an optimal input of oxygen to the user.

By the terms "torso area", this means the portion of the body situated above the pelvis and under the head of the user, in any case below the nose of the user.

By the terms "thorax area", this means the portion of the body situated above the diaphragm and under the head of the user, in any case, below the nose of the user.

By the terms "under-head area", this means the portion of the body situated under the nose of the user.

Preferably, said at least one means for directing the surrounding air comprises a tube connected at a first end to said surrounding air outlet, preferably said tube is a flexible tube, possibly by means of a connector.

Indeed, a flexible tube is, from an ergonomic standpoint, particularly adapted to directing the surrounding air to the respiratory tract of the user, without impeding the movements of the user. The tube can be made of any material making it possible for the passage of air to the desired area of the user, for example, the tube can be made of textile, of polymer material, of silicone, of polycarbonate, of PVC, of nitrile, of thermoplastic polyurethane.

Preferably, a second end of said at least one means for directing the surrounding air is arranged to be connected to a second interface present on an underclothing and equipped with at least one air outlet orifice.

Indeed, when a second interface is present on an underclothing, for example, sewn or fixed, it remains in place when the operator works and carries out their mission.

The second interface is preferably present in a thorax area, connected to the second end of said means for directing the surrounding air, which makes it particularly adapted to the diffusion of the surrounding air to the user.

More preferably, the second interface is sewn to a material part, for example a fabric part. Said material part comprises fixing means, preferably at least one pushbutton arranged to reversibly fix said second interface to said underclothing.

Advantageously, the active breathing system according to the present invention further comprises an underclothing comprising at least one fixing system, for example as least one pushbutton. Indeed, an underclothing is particularly advantageous in a system according to the present invention, as it makes it possible, for example, the fixing of the aeration device to the underclothing worn by an operator and facilitates the fixing inside the overalls, at a placement respectively opposite the placement of the first air suctioning interface on the outside of overalls in order to optimally connect the lateral tube and the air suctioning tube. The underclothing further comprises an elastic belt situated in one single tunnel. The single tunnel comprises at least one opening arranging to give access to the elastic belt, preferably to make it possible for the fixing of the first longitudinal hollow body to the elastic belt of the underclothing.

More preferably, said second interface is fixed, preferably at least one pushbutton or sewn on the underclothing and comprises a second hollow body equipped with a collar equipped with a peripheral groove intended for its fixing to the material part, preferably to house a sewing of the material part to said second interface, said second hollow body furthermore being equipped with an orifice for connecting to said second end of said at least one means for directing the surrounding air, and at least one air outlet.

Even more preferably, said at least one means for directing the surrounding air is fixed to the underclothing in a thorax area, more particularly a shoulder area, for example using an additional material part arranged so as to form a loop maintaining an end of said at least one means for directing the surrounding air against the underclothing, said loop or said additional material part being attached to the underclothing, for example, by a pushbutton system. Indeed, by being fixed, preferably pressure-attached or sewn on the underclothing, the second interface and the at least one means for directing the surrounding air have a fixed position, and an optimal positioning for the oxygen input in an area selected of the user. In addition, the second hollow body equipped with at least one air outlet makes it possible for a better diffusion of the surrounding air and a flow which is comfortable for the operator, as it does not impede, and on the contrary, it facilitates the air outlet, more specifically, it makes it possible to diffuse without draining the mucous membranes of the user.

Preferably, the active breathing system according to the present invention further comprises an aseptic overalls which is equipped with said first interface, said first interface preferably comprising a peripheral recess to house a sewing of the overalls to said interface.

Advantageously, the overalls of the active breathing system according to the present invention is preferably provided for a cleanroom and comprises an outer face provided to be in contact with a surrounding environment and an inner face arranged to be in contact with a handler, a first and a second leg cross-section, an opening comprising a closing means in a crotch area, preferably along each first and second leg cross-sections, for example a clear closing, a first and a second sleeves and a body portion to which the first and second sleeves are connected by a linked end, the first and second leg cross-sections being also connected to the body cross-section by a linked end, said body portion comprising a head passage cross-section.

In a preferred embodiment, the overalls of the active breathing system according to the present invention further comprises at least one first grasping means, in contact with the inner face in the body portion.

Indeed, an active breathing system comprising such an aseptic overalls advantageously makes it possible to have a overalls provided to be integral with said first interface. In this manner, the aseptic conditions, despite the orifice provided for the surrounding air inlet in the overalls are perfectly preserved and the securing of the overalls via said first interface to the active breathing device is adjusted. When the active breathing device is worn at the waist by the operator, preferably at the level of at least one opening arranged to give access to the elastic belt, which is often the most overalls able to not impede the work of the operator, the first interface is located laterally on the overalls. Depending on where the air suctioning tube is situated, when the device is worn by an operator laterally between the waist and the armpits or rather on the hip or on the top of the thigh, the first interface is thus sewn on the overalls, laterally on the body or leg cross-section, below the portion connected to the sleeve or in the upper half of the leg.

In a particularly advantageous embodiment of the system according to the system according to the present invention, the overalls is that forming the subject of application EP2303044 and is provided packaged and folded aseptically in an individual package. It is thus put on without handling nor assistance, by simplifying the wearing procedures and by avoiding costly errors. In the system according to the present invention, the aeration device is isolated by the overalls worn by the operator of the sterile external environment of the cleanroom such that the active breathing system makes it possible to reduce the constraining handling steps as indicated above.

Preferably, said first longitudinal hollow body has an open proximal end, said open proximal end being adjacent to said ventilator, and a closed distal end, said closed distal end being adjacent to said energy source. Advantageously, said first longitudinal hollow body having an outer wall and an inner wall, said outer wall being equipped with a fixing means arranged to make it possible for the fixing of said longitudinal hollow body reversibly, for example at the level of the hips of said user, preferably said fixing means is a slider arranged to make it possible for the fixing to a belt of said user.

Possibly, said open proximal end comprises a valve arranged to ensure, in an open position, the passage of the surrounding air of a cleanroom inside the overalls and to ensure, in a closed position, the perfectly sealed blocking of the open proximal end of said first longitudinal hollow body. This furthermore makes it possible to prevent the passage of air inside the overalls to the surrounding environment.

Alternatively, said first hollow body is equipped with one or two straps to be worn on the back, on the stomach or on the hips of an operator.

Indeed, the presence of a fixing means on the outer wall of the first longitudinal hollow body of the aeration device makes it possible for its fixing to a specific placement and selected by the user and/or imposed by the facing position with the first air suctioning interface, preferably at the level of at least one opening arranged to give access to the elastic belt, such that the user is not disturbed by the presence of the aeration device and remains free for their handling.

Advantageously, said first longitudinal hollow body has an open proximal end, said open proximal end being adjacent to said ventilator, and a closed distal end, said closed distal end being adjacent to said energy source.

Preferably, said first longitudinal hollow body has a wall, substantially perpendicular to said inner wall arranged to separate said ventilator in a first separate compartment and said energy source in a second separate compartment. Said wall comprising connection means to make it possible for the passage of the current between the energy source and the motor of the ventilator or is passed through by a rotating axis ensuring the rotation of the turbine.

Alternatively, said first longitudinal hollow body is composed of a first part comprising said open proximal end, said ventilator, possibly the motor of the ventilator, said surrounding air suctioning tube and a second part comprising the closed distal end and said energy source, for example a battery, preferably a rechargeable battery.

Said first and second parts of said first longitudinal hollow body comprising connection means to make it possible for the passage of the current between the energy source and the motor of the ventilator.

Indeed, it is particularly advantageous to have a first longitudinal hollow body composed of a first part and a second part which could be connected by screwing, by clipping, by interlocking. Furthermore, this makes it possible to facilitate the replacement and the recharging of the energy source, for example a battery, preferably a rechargeable battery independently of the first part which can remain fixed to the underclothing.

Also, the first part and the second part of said first longitudinal hollow body being independent from one another, this facilitates their respective maintenance.

Preferably, said outer wall of said first longitudinal hollow body is equipped with a switch arranged to activate or stop said ventilator, preferably said switch is a mechanical or electronic switch, of which the actuation can be carried out by the connection of said air inlet means to said surrounding air suctioning tube, or for example, a pushbutton.

Indeed, the user, via the switch can activate or stop the ventilator, this makes it possible for it to have the surrounding air, for example, at the time when their overalls is put on.

Preferably, said first air suctioning interface is furthermore connected reversibly to said first longitudinal hollow body of said aeration device by a connection element, preferably by a forced interlocking, for example by abutment or by crimping. This makes it possible for a better connection between the aeration device and the first air suctioning interface by means of their respective surrounding air suctioning tube and lateral tube.

Preferably, said outer wall of said first longitudinal hollow body comprises a recess arranged to receive said connection element, for example by a forced interlocking, for example by abutment or by crimping.

Preferably, said connection element is circular arc-shaped and moulds the shape of said recess of said first longitudinal hollow body.

Preferably, the distance between the free ends of said circular arc when idle is slightly less than the distance separating the two points with which the two free ends must, in the fixing position, be in contact. In this manner, in the fixing position, a tension is ensured by said connection element to said aeration device which holds the latter in place.

More preferably, said main wall of said first air suctioning interface is furthermore equipped with a grasping means extending transversally with respect to said main wall.

Indeed, this makes it possible for the user to have a grip, facilitating the grasping of the first air suctioning interface located outside of the overalls, for example, to carry out the forced interlocking with the aeration device which is located inside the overalls. With the grasping means being outside, it is sterile and must remain so. Consequently, the grasping of it to connect the active breathing device will be done, either through the fabric of the sleeve, or once the operator has covered their gloves. In addition, the grasping by the grasping means makes it possible, also to facilitate the disconnection upon undressing.

Advantageously, said first air suctioning interface is made of thermoplastic polyurethane, and/or nitrile group-based rubber, preferably made of butadiene-acrylonitrile copolymer.

Other embodiments of the active breathing system according to the invention are indicated in the appended claims.

Other features, details and advantages of the invention will emerge from the detailed description given below, in a non-limiting manner, and by making reference to the appended drawings.

In the figures, identical or similar elements have the same references.

Figure 1:
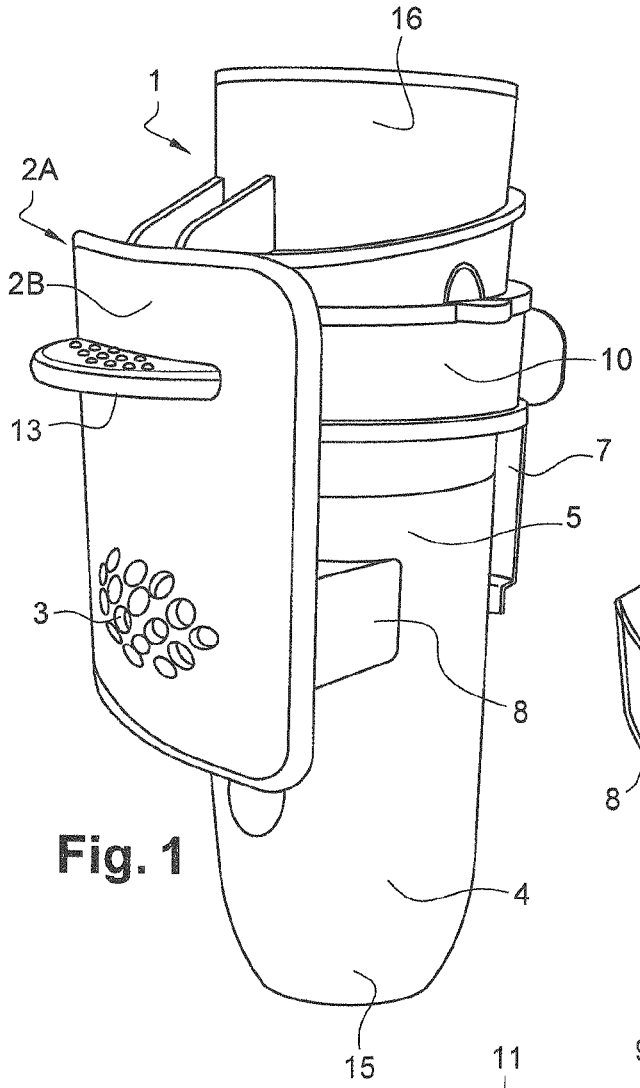
FIG. 1 represents the aeration device and the first air suctioning interface of the system according to the present invention.

As indicated above, this aeration device 1 makes it possible to orient the surrounding air of a cleanroom in an internal portion of aseptic overalls 24, preferably upwards. The latter being arranged to be worn by a user.

The system comprises an aeration device 1 formed of a first longitudinal hollow body 4 which has an outer wall 5 and an inner wall 6 (not visible). The first longitudinal hollow body 4 has a closed distal end 15 and an open proximal end for the outlet of surrounding air 11 which directs air upwards. The outer wall 5 is equipped with a fixing means 7 which is arranged to be fixed reversibly to a user, more specifically to the hips of a user. The fixing means 7 is, for example, a slider arranged to be fixed to the belt of a user, for example, to the belt of the underclothing of a user. Possibly, the underclothing further comprises an elastic belt situated in one single tunnel. The single tunnel comprises at least one opening arranged to give access to the elastic belt, preferably to make it possible for the fixing of the first longitudinal hollow body 4 to the elastic belt of the underclothing.

The aeration device 1 further comprises a surrounding air suctioning tube 8 in fluidic communication with the inside of the first longitudinal hollow body 4.

The inner wall 6 of the first longitudinal hollow body 4 forms a space wherein is housed a ventilator 9 (not visible) and an energy source arranged to be connected and to supply the ventilator 9.

The first longitudinal hollow body 4 can also be equipped with a connector 16 at the level of the open proximal end for the output of surrounding air 11 arranged to facilitate and optimise the insertion of a means for directing 17 the surrounding air (not visible).

The system also comprises a first air suctioning interface 2A which comprises a main wall 2B which has at least one orifice 3, possibly a plurality of orifices, preferably equipped with a filtering membrane, to make it possible for the passage of the surrounding air of a cleanroom inside the aseptic overalls 24, more specifically to an internal portion of the overalls 24. A grasping means 13 which extends transversally with respect to the main wall 2B of the first air suctioning interface 2A. This grasping means 13 makes it possible to have a grip facilitating the grasping of the first air suctioning interface 2A which is located outside of the overalls 24, for example to carry out a forced interlocking with the aeration device 1 which is located inside the overalls 24 or to disconnect the device at the moment of undressing.

The first air suctioning interface 2A comprises a lateral tube 8' (not visible) present on the secondary wall, opposite the main wall 2B. The lateral tube 8' is arranged to extend through the aseptic overalls 24 to the inside of it and to be connected to the surrounding air suctioning tube 8 of the first longitudinal hollow body 4 of the aeration device 1. In the representation of FIG. 1, the lateral tube 8' (not visible) is positioned inside the surrounding air suctioning tube 8 such that the latter surrounds the lateral tube 8', conversely the lateral tube 8' in another embodiment can be positioned outside and surround the surrounding air suctioning tube 8.

The surrounding air therefore passes through the orifice(s) 3, under the action of the suctioning created by the rotational movement of the turbine of the ventilator 9 thanks to the geometry of the blades, passes through the lateral tube 8' and the surrounding air suctioning tube 8. The surrounding air is thus brought into the first longitudinal hollow body 4 and emerged, oriented, pushed by the rotation of the turbine of the ventilator 9 through the open proximal end of the outlet of surrounding air 11 of the aeration device 1.

The first air suctioning interface 2A can also comprise a connecting element 10 making it possible to reversibly connect said first air suctioning interface 2A to the aeration device 1, preferably this connection is made by a forced interlocking, preferably by abutment or by crimping.

Preferably, said connecting element 10 is circular arc-shaped and moulds the shape of said recess 12 of said first longitudinal hollow body 4.

Preferably, the distance between the free ends of said circular arc when idle is slightly less than the distance separating the two points with which the two free ends must, in the fixing position, be in contact. In this manner, in the fixing position, a tension is ensured by said connection element 10 to said aeration device 1 which holds the latter in place.

Figure 2:
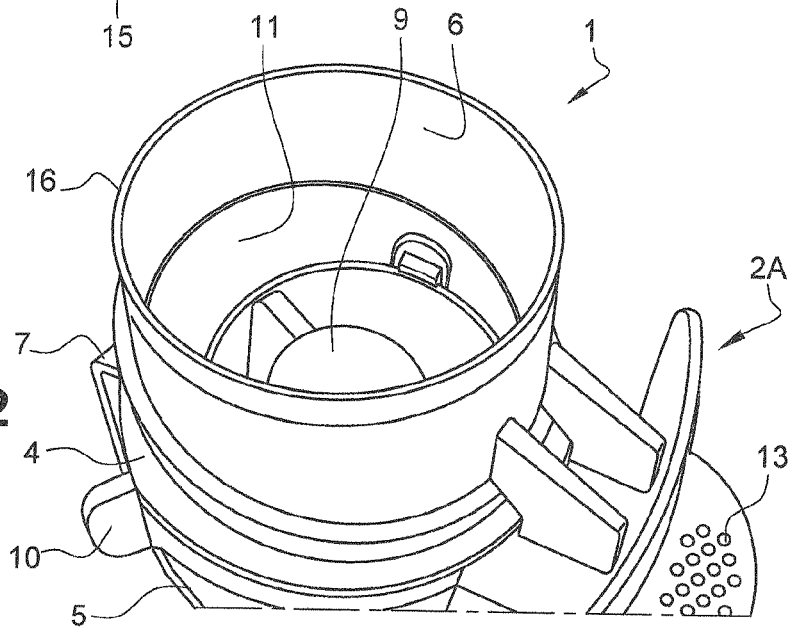
FIG. 2 is a top view of the system according to the invention comprising the aeration device and the first air suctioning interface.

FIG. 2 represents the system according to the invention comprising the aeration device 1 and the first air suctioning interface 2A as a top view.

In this representation, as can be seen, the system according to the invention comprises, on the one hand, the aeration device 1 is formed of the first longitudinal hollow body 4, which comprises an outer wall 5 equipped with the fixing means 7, and an inner wall 6, and on the other hand, the first air suctioning interface 2A comprising a main wall 2B equipped with the grasping means 13 and on the secondary wall opposite the main wall 2B, the means for connecting 10 the first air suctioning interface 2A to the aeration device 1.

Furthermore, this representation illustrates more specifically the aeration device 1 as a top view, the space formed by the inner wall 6 of the first longitudinal hollow body 4 is provided to house the ventilator 9 making it possible for the outlet of the air at the level of the open proximal end of the outlet of surrounding air 11, said air entering beforehand in the aeration device 1 through at least one orifice 3 of the first air suctioning interface 2A situated outside of the overalls 24 and through the passage, through a channel formed by respectively the lateral tube 8' of the first air suctioning interface 2A and the surrounding air suctioning tube 8 of the aeration device 1. The proximal end of the outlet of surrounding air 11 of the first longitudinal hollow body 4 can possible be extended by a connector 16 making it possible to facilitate the connection of a means for directing 17 the surrounding air (not visible).

The ventilator used according to the invention comprises a turbine equipped with blades rotating about an axis arranged to suction air through said surrounding air suctioning tube 8 and to make it exit through said proximal end of the outlet of surrounding air 11 of the first longitudinal hollow body 4. The turbine rotates by activation of a switch, for example a mechanical or electronic switch and receives energy from the energy source to which it is connected, preferably the first longitudinal hollow body 4 has a central longitudinal axis which is aligned to the axis of rotation of said turbine. Preferably, the ventilator is activated by the connection of the surrounding air suctioning tube 8 and the lateral tube 8' of the first air suctioning interface 2A.

Figure 3:
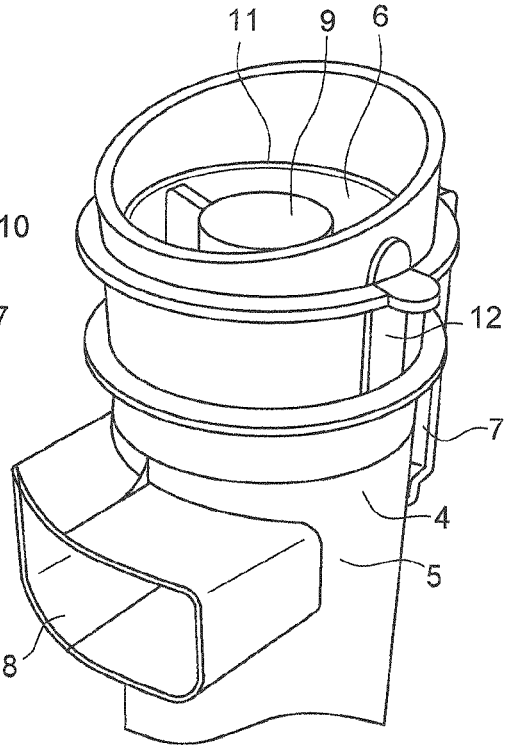
FIG. 3 is a lateral view of the first longitudinal hollow body of the aeration device.

FIG. 3 illustrates the first longitudinal hollow body 4 of the aeration device 1 as a lateral view.

In this representation, it shows the inner wall 6 forming a space provided to house the ventilator 9 and to make it possible for the outlet of air at the level of the open proximal end of the outlet of surrounding air 11. This, the ventilator makes it possible to orient the air coming from the air suctioning tube 8 outside of said first longitudinal hollow body 4 in the direction of the internal portion of the overalls 24, upwards.

The outer wall 5 of the first longitudinal hollow body 4 is equipped with the fixing means 7 and with the air suctioning tube 8. More specifically, said outer wall 5 comprises a recess 12 arranged to receive the connecting element 10 of the first air suctioning interface 2A by a forced interlocking, for example by abutment or by crimping, more specifically the connecting element 10 is, for example, a clip which is fixed around the first longitudinal hollow body 4 or also in a circular arc shape which enters by forced interlocking in abutment against the recess 12 of said first longitudinal hollow body 4 of the aeration device 1.

Preferably, said connecting element 10 is a circular arc shape and moulds the shape of said recess 12 of said first longitudinal hollow body 4.

Preferably, the distance between the free ends of said circular arc when idle is slightly less than the distance separating the two points with which the two free ends must, in the fixing position, be in contact. In this manner, in the fixing position, a tension is ensured by said connecting element 10 to said aeration device 1 which holds the latter in place.

Figure 4:
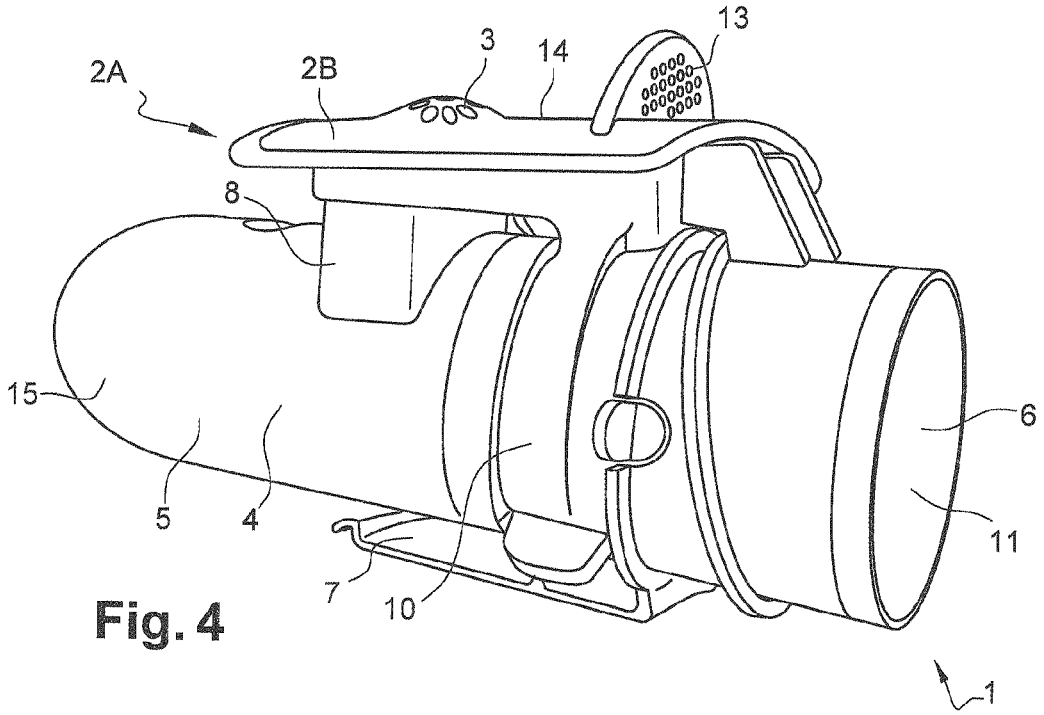
FIG. 4 is a lateral view of the system according to the invention comprising the aeration device and the first air suctioning interface.

FIG. 4 is a lateral view of the system according to the invention in the mounted state, i.e. when the surrounding air suctioning tube 8 of the aeration device 1 and the lateral tube 8' of the first air suctioning interface 2A are connected, by an interlocking system, inside one another or conversely, possibly using a seal, which can also contribute to the forcing of the interlocking.

This FIG. 4 illustrates, in particular, the first air suctioning interface 2A of curved shape which has a top 14 which extends over the main wall 2B, furthermore, this figure also illustrates the closed distal end 15 of the first longitudinal hollow body 4. In the first longitudinal hollow body 4, in the proximity of the closed distal end 15 is formed a cavity provided to house an energy source, for example a battery, and possibly the motor of the ventilator 9.

In a preferred embodiment, the first longitudinal hollow body 4 is separated by a transversal, two-portion wall. The first portion, on the side of the proximal end 11 is arranged to preferably house the turbine of the ventilator 9 while the second portion, on the side of the distal end 15 of the first longitudinal hollow body 4 is provided to house the energy source and the motor. The motor actuates an axis of rotation of the turbine, which extends through the transversal wall. Seals not impeding or hardly rotating the axis ensure the sealing between the first and the second portion of the first longitudinal hollow body 4.

Figure 5:
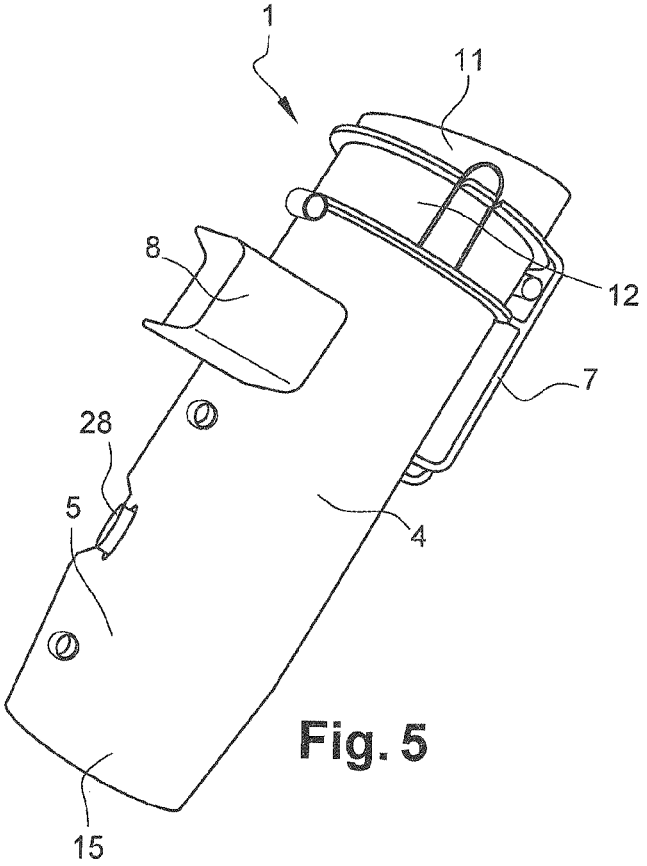
FIG. 5 is a lateral view of an alternative of the aeration device.
Figure 6:
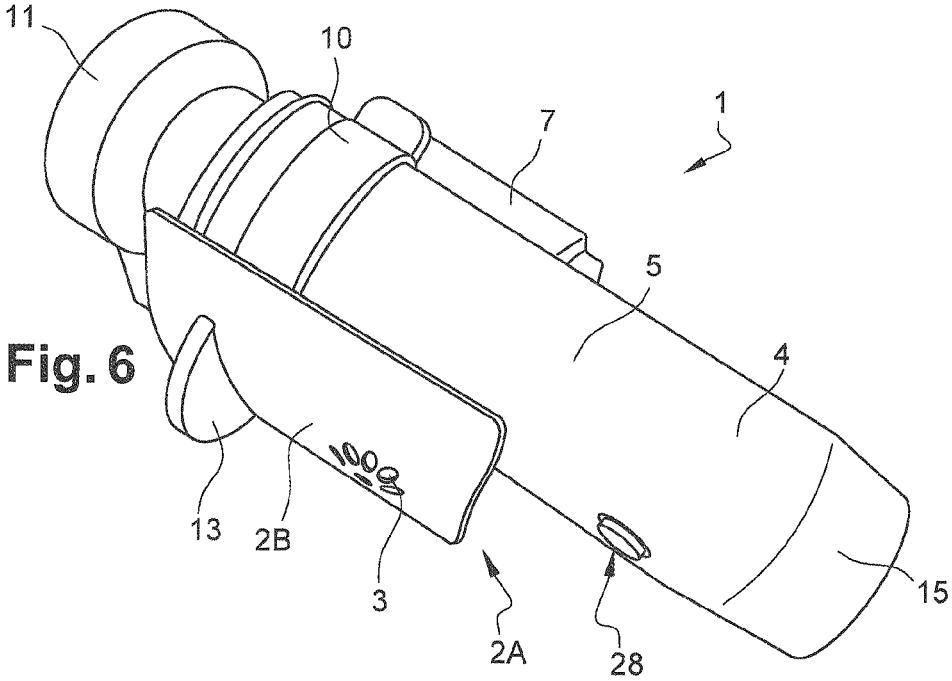
FIG. 6 represents an alternative of the system according to the invention comprising the aeration device and the first air suctioning interface.

FIG. 5 illustrates an alternative of the aeration device 1 and FIG. 6 represents the system according to the invention comprising the aeration device 1 according to the alternative of FIG. 5 and the first air suctioning interface 2A.

Furthermore, the outer wall 5 of the first longitudinal hollow body 4 of the aeration device 1 is equipped with a switch 28, preferably a mechanical switch, for example a pushbutton arranged to activate and/or deactivate the ventilator 9.

Figure 7:
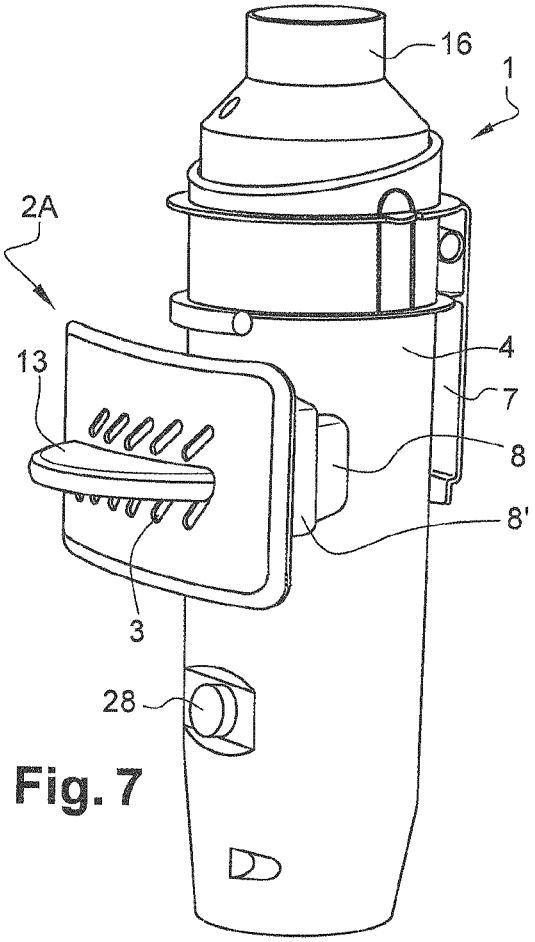
FIG. 7 represents another alternative of the system according to the invention comprising the aeration device and the first air suctioning interface.

FIG. 7 illustrates an alternative of the system according to the invention comprising the aeration device 1 and the first air suctioning interface 2A.

In this representation, the first longitudinal hollow body 4 of the aeration device 1 is equipped with a switch 28, a fixing means 7 and a connector 16 such as presented above. The first air suctioning interface 2A is equipped with a grasping means 13 extending transversally to the main wall 2B, furthermore, said main wall 2B comprises two series of at least one orifice 3 of the outlet of surrounding air, said two series being positioned on either side of the grasping means 13 in the longitudinal direction.

Figure 8:
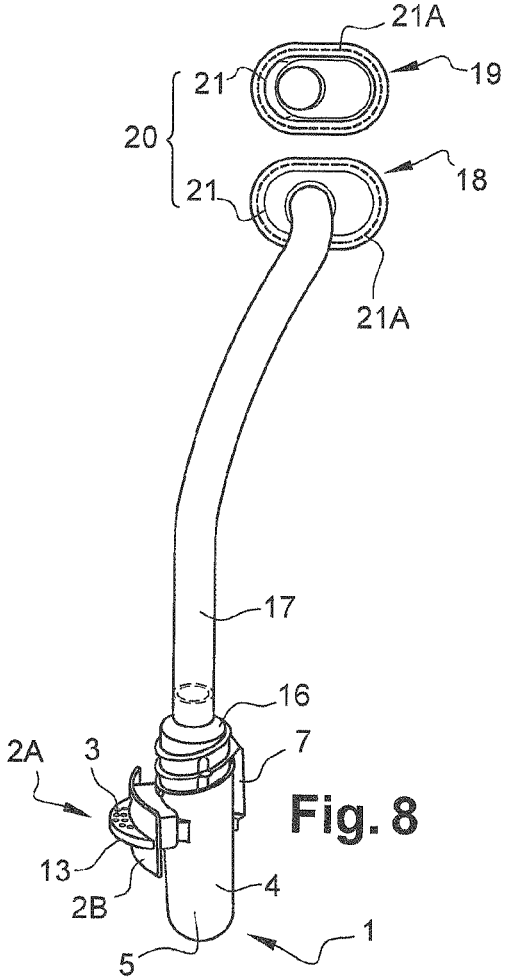
FIG. 8 represents a system according to the invention comprising the aeration device, the first air suctioning interface, the means for directing the surrounding air and the second interface.

FIG. 8 illustrates the alternative of the system according to the invention of FIG. 7 to which is added a means for directing 17 the surrounding air, comprising a tube, for example a flexible tube, and a second interface 20 formed in the present case of two complementary parts 18, 19 sewn on either side of an underclothing.

More specifically, a first end of the means for directing 17 the surrounding air is connected to the aeration device 1 by means of the connector 16, the second end of the means for directing 17 the surrounding air is connected to the second interface 20 formed of the two complementary parts 18, 19 which each comprises a collar 21 equipped with a peripheral groove 21A intended to house a sewing of the underclothing to said two complementary parts 18, 19 on either side of an underclothing in order to form the second interface 20. The second interface 20 comprises a first hollow body 18 as well as an air inlet orifice 30 and an air outlet orifice 31 (not illustrated). The second interface 20 also comprises a second hollow body 19 complementary to the first hollow body 18 and comprises the same orifices 30 and 31.

Figure 9A:
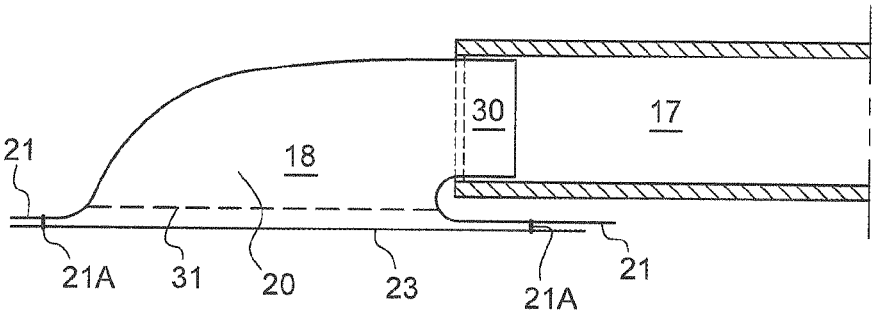
FIGS. 9A and 9B represent two alternatives of the connection between the means for directing the surrounding air and the second interface.
Figure 9B:
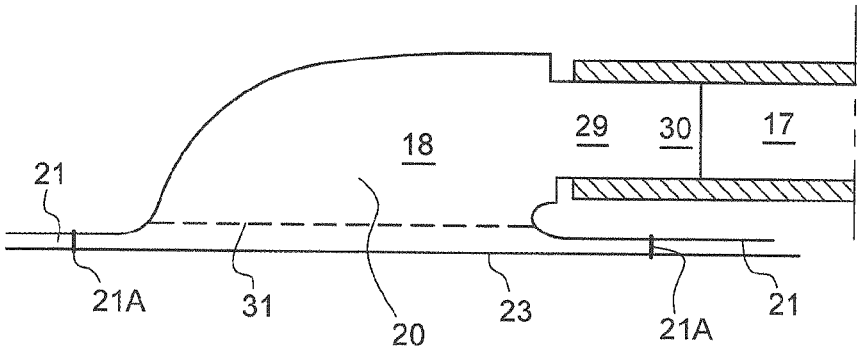

FIGS. 9A and 9B illustrate two variants of the second interface 20 where the connection between the means for directing 17 the surrounding air and the first hollow body 18 of the second interface 20 is illustrated in two ways.

Figure 9C:
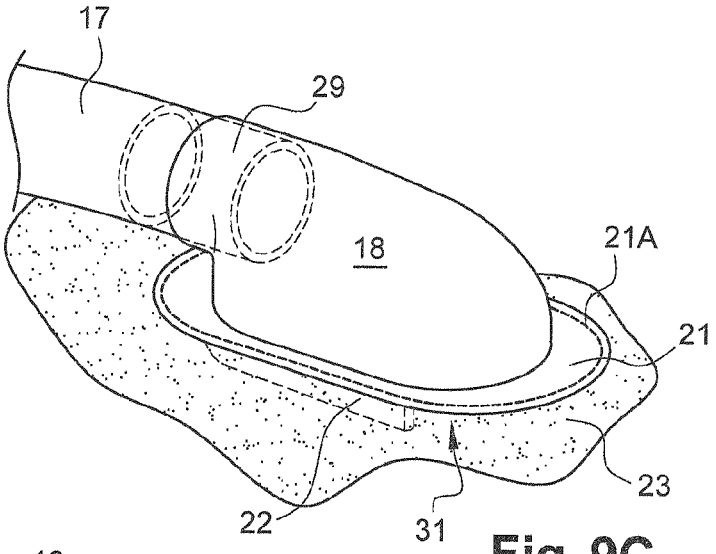
FIGS. 9C and 9D represent an alternative of the second interface.
Figure 9D:
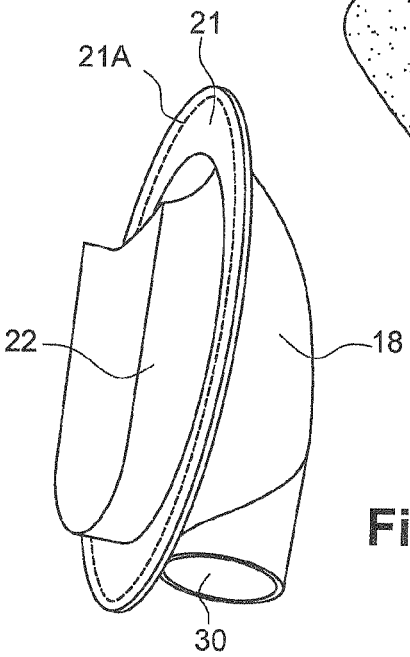

In the embodiment illustrated in FIG. 9A or in FIG. 9B, or also in FIGS. 9C and 9D as well as in FIG. 8, the second interface 20 comprises a first hollow body 18 substantially extended. It comprises a substantially flat wall forming a collar 21 around a relatively oval air inlet orifice 30. The collar comprises a peripheral recess 21A in order to house there a sewing of said second interface 20 to at least one fabric thickness 23 of the underclothing. The second interface 20 also comprises a surrounding air outlet orifice 31, which is generally situated perpendicularly with respect to said air inlet orifice 30. In the variants of FIGS. 9A, 9B, 9C and 9D, of the edge of the air inlet orifice 30 in the first hollow body 18 extends a sleeve-shaped tube 29 of which the cross-section is either smaller, or slightly larger than that of the direction means 17, in order to house it in the tube 29 or, on the contrary, to house the direction means 17 in the tube 29.

FIGS. 9C and 9D illustrate a variant of the second interface 20 which also comprises a first hollow body 18 having a flat wall forming a collar 21 around an air outlet orifice 31. The hollow body also comprises an air inlet orifice 30 (not illustrated) from which extends a tube 29 to house the air direction means 17. In this representation, the collar 21 is equipped with a peripheral groove 21A intended to house a sewing line of the underclothing. The hollow body 18 also comprises one or more spacers 22 extending substantially transversally from said collar 21 opposite the hollow body 18, the spacer(s) 22 is/are furthermore arranged to create a space facilitating the air outlet, either between a fabric thickness and the body of the operator, or between two thicknesses of an underclothing so as to make it possible for the passage of the surrounding air between these two thicknesses.

Figure 10C:
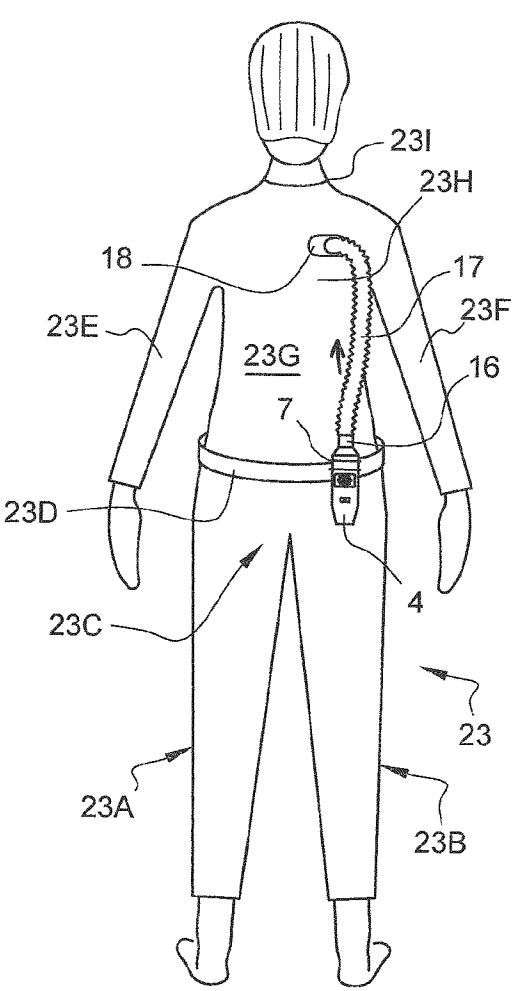
FIGS. 10A, 10B and 10C represent the fixing of the aeration device connected to the means for directing the surrounding air and to the second interface on the underclothing of a user.
Figure 10B:
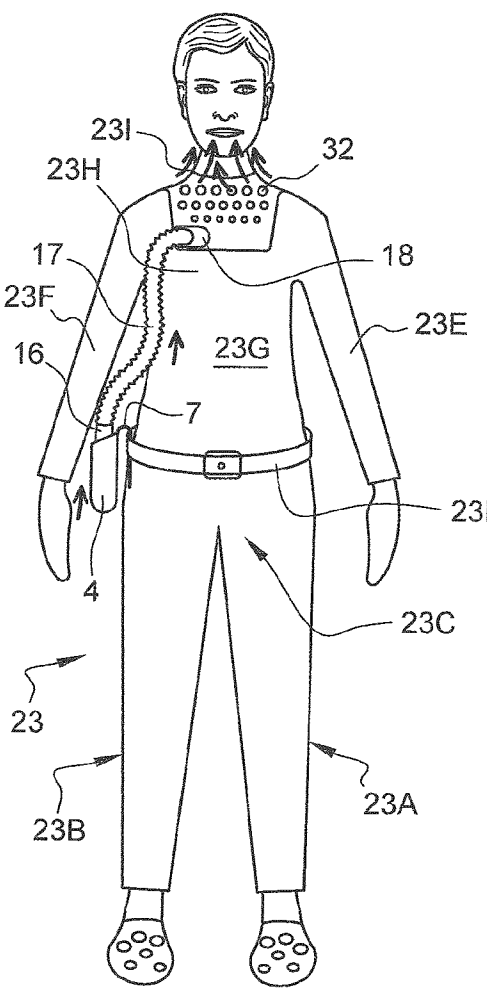
Figure 10A:
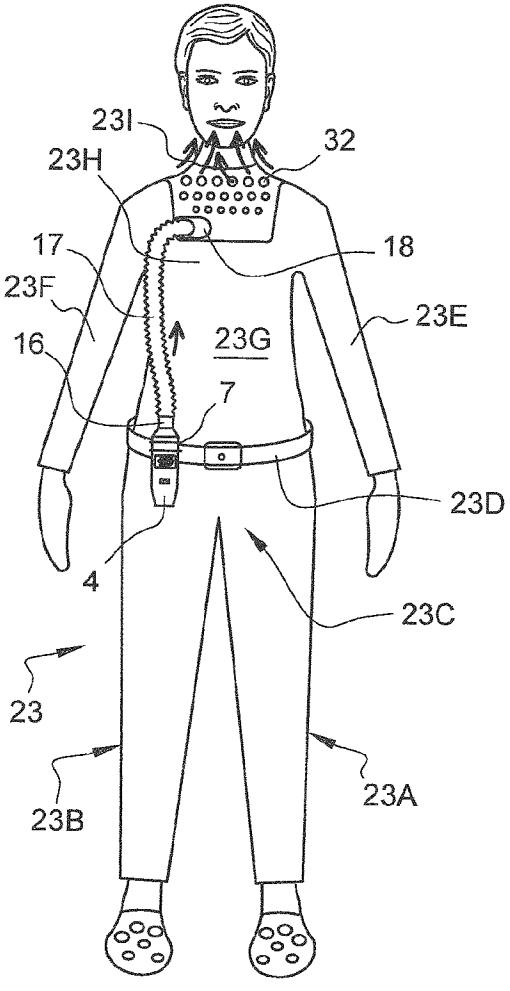

FIGS. 10*a*, 10*b* and 10*c* illustrate a breathing system according to the invention comprising an aeration device 1 and an underclothing 23. The underclothing comprises a pair of shorts or a pair of trousers comprising two substantially tubular leg cross-sections 23A and 23B to house the legs of an operator there, and a pelvis cross-section 23C to house the pelvis of an operator there. The pelvis cross-section is connected to the two leg cross-sections and ends opposite by a waist cross-section 23D, possibly equipped with a belt.

Furthermore, the aeration device 1 can be alternatively placed in different places, for example at the level of the pelvis on the face portion of the user (FIG. 10*a*), at the level of the hips on the profile portion of the user (FIG. 10*b*), or also at the level of the pelvis on the back portion of the user (FIG. 10*c*). In addition, the aeration device 1 can be placed, both on the left side and on the right side of the user.

The underclothing also comprises a top portion in the form of a T-shirt with short or long sleeves. The top portion comprises a first and a second sleeve cross-section 23E and 23F each connected to a torso cross-section 23G comprising the thorax cross-section 23H and the neck cross-section. The neck cross-section comprises a head passage orifice 23I. Each abovesaid cross-section can be formed or one single part or of several parts sewn together. Identically, several cross-sections can be formed of one single part or of several parts sewn together.

The first longitudinal hollow body 4 of the aeration device 1 is equipped such as illustrated, with a fixing means 7, for example a slider, making it possible for the fixing to the belt of the underclothing of the user. A first end of the means for directing 17 the surrounding air is connected to the first longitudinal hollow body 4 by means of a connector 16. The means for directing 17 the surrounding air brings the surrounding air into a thorax area, preferably in an upper portion of the thorax area and in any case, below the head of the operator, under the face area. Subsequently, the second end of the mean for directing 17 the surrounding air is connected to the hollow body 18 of the second interface 20 which is sewn to said underclothing, preferably in a thorax area, in any case, in an under head area of the underclothing such that the surrounding air gets to the user in an area making it possible for an optimal breathing. The second interface 20 is therefore sewn in a thorax area of the underclothing. The underclothing comprises a series of surrounding air outlet orifices 32.

As can be seen, depending on the underclothing comprising a fabric thickness or two fabric thicknesses, the passage of air will be slightly different. If the underclothing comprises a fabric thickness, the surrounding air passes through the tube 17, under the underclothing and emerges through the most direct path, that is through the series of born orifices 32 through the fabric thickness, at the level of the neck of the underclothing, as well as through the head passage orifice. If the underclothing comprises at least two fabric thicknesses in the neck cross-section of the underclothing, the surrounding air passes through the direction means 17 through the outer fabric thickness, and ends up between the two fabric thicknesses to emerge through the series of orifices 32. The at least two thicknesses being connected by the sewing of the head passage orifice; the air outlet through the head passage orifice is thus reduced. The air outlet orifices 32 are provided such that the airflow is comfortable for the user, i.e. that the surrounding air entering into the overalls 24 of the user must not drain the mucous membranes of the user during breathing and the air exchanges between the inside and outside of the overalls 24 do not disturb the air of the cleanroom and do not create any overpressure in the overalls.

Alternatively, the means for directing 17 the surrounding air is situated in the back of the user.

Figure 11:
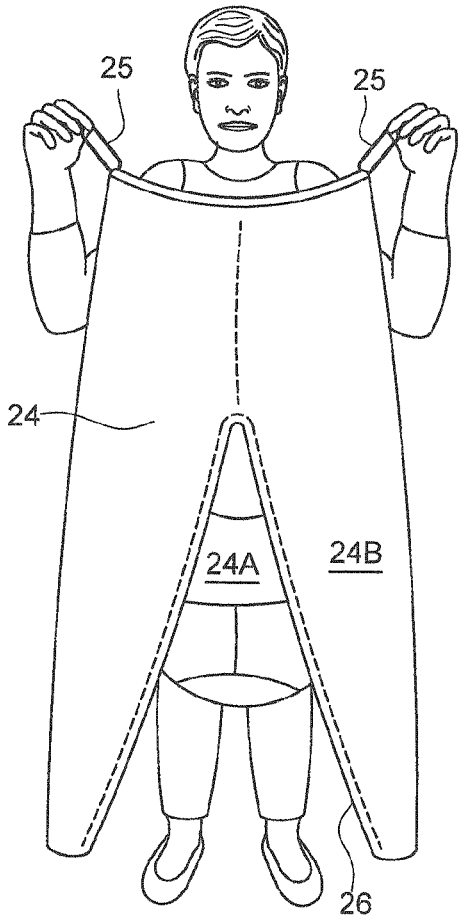
FIG. 11 represents aseptic overalls of the system according to the invention.
Figures 12A, 12B, 12C:
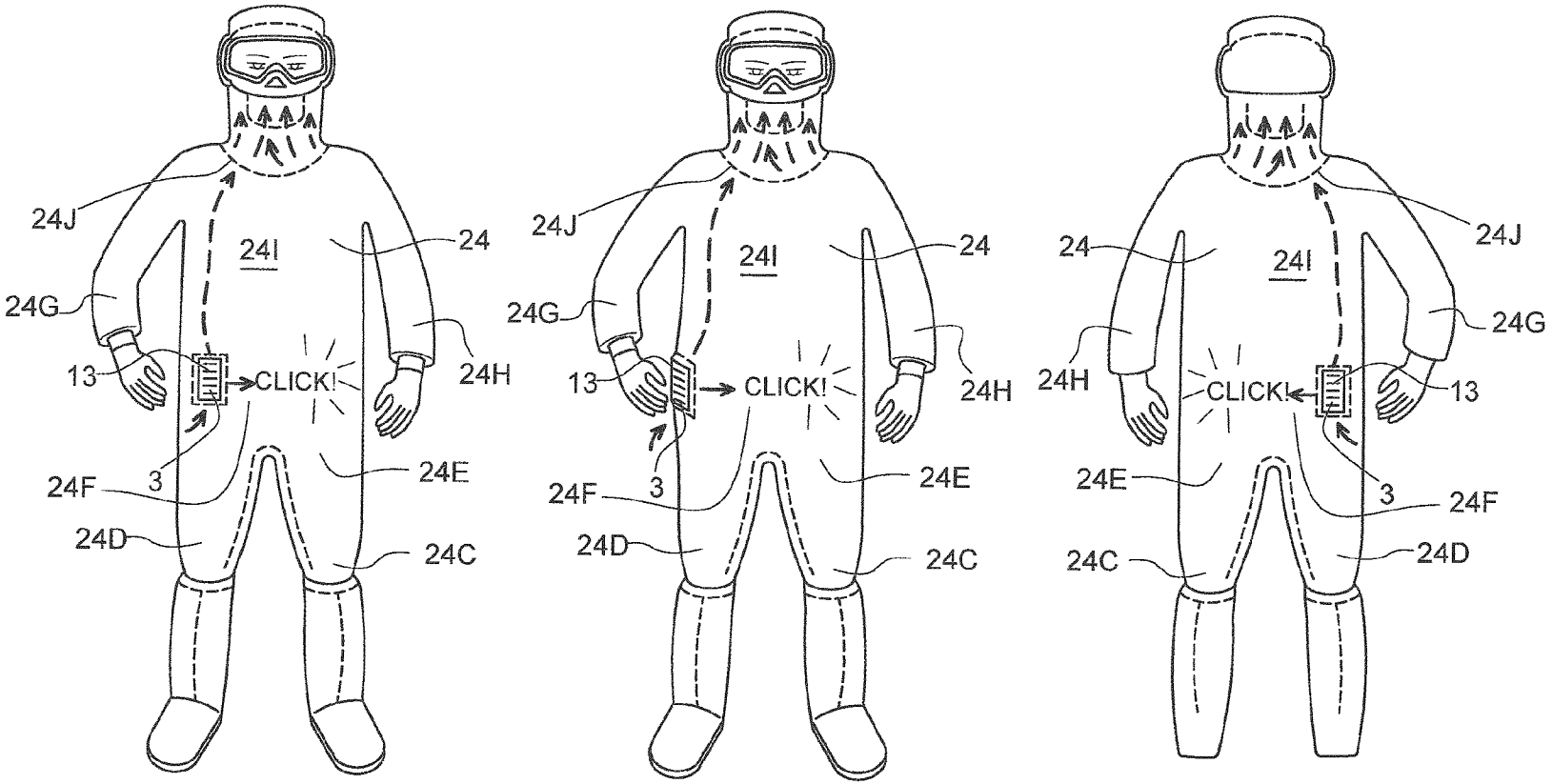
FIGS. 12A, 12B, 12C, 12D, 12E and 12F represent a user after having put on the overalls of the system according to the invention.
Figures 12D, 12E, 12F:
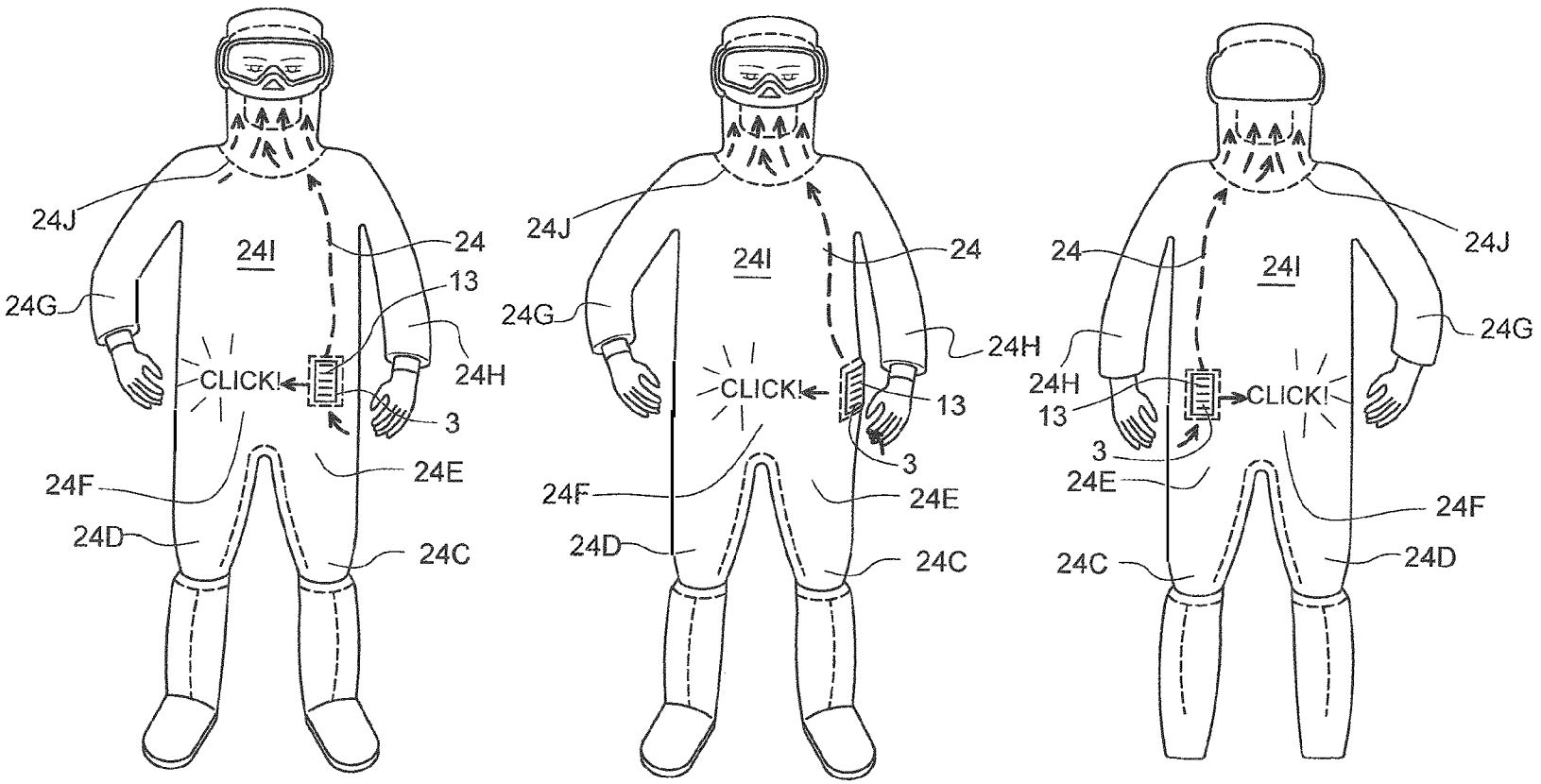

FIG. 11 illustrates an aseptic overalls 24 of the system according to the invention, indeed said overalls 24 comprises an outer face 24A provided to be in contact with the surrounding environment of the cleanroom and an inner face 24B provided to be in contact, direct or indirect with the user, indeed an underclothing can be present between the inside of the overalls 24 and the user. The overalls 24 also comprises a first and a second leg cross-section 24C and 24D, substantially tubular to house the legs of an operator there, connected to either through an opening comprising a closing means 26 in a crotch area, for example a zip, preferably along each first and second leg cross-section 24C and 24D. A pelvis cross-section 24E to house the pelvis of an operator there, the pelvis cross-section 24E is connected to the two leg cross-sections and ends opposite through a waist cross-section 24F. The overalls 24 also comprises a top portion comprising a first and a second sleeve cross-section 24G and 24H each connected to a torso cross-section 24I comprising the head passage cross-section 24J. The head passage cross-section 24J is connected to the hood 24K. Each abovesaid cross-section can be formed of one single part or of several parts sewn together. Identically, several cross-sections can be formed of one single part or of several parts sewn together. Furthermore, the overalls 24 comprises a first grasping means 25, in contact with the inner face in the body portion.

FIGS. 12A to 12F illustrate the user after having put on the aseptic overalls 24 of the system according to the invention. Indeed, the first air suctioning interface 2A is situated on the aseptic overalls 24, more specifically the user holds the grasping means 13 which extends transversally with respect to the main wall 2B in contact with the surrounding environment of the cleanroom, after holding the grasping means 13, the user will push the first air suctioning interface 2A so as to make it possible for the interlocking of two tubes 8 and 8', in order to make it possible for the passage of the surrounding air of the surrounding air inlet orifices 3 to said at least one surrounding air outlet orifice 32 situated inside the aseptic overalls 24 to make it possible for the breathing of the user.

The first air suctioning interface 2A can, alternatively, be positioned both on the left side and the right side of the aseptic overalls 24 and on the face portion, on the side or on the back portion of the aseptic overalls 24.

As can be seen, in this embodiment, the overalls 24 comprises a hood connected to the head passage cross-section equipped with protective glasses, such as for example those described in EP3318144, EP3223916, and EP2823859. The hood is also equipped with a wall intended to cover the nose and the mouth made of a filtering material, letting gaseous molecules easily exit, but molecules of which the porosity retains the microorganisms likely to be expelled by the breathing of the operator.

Figure 13:
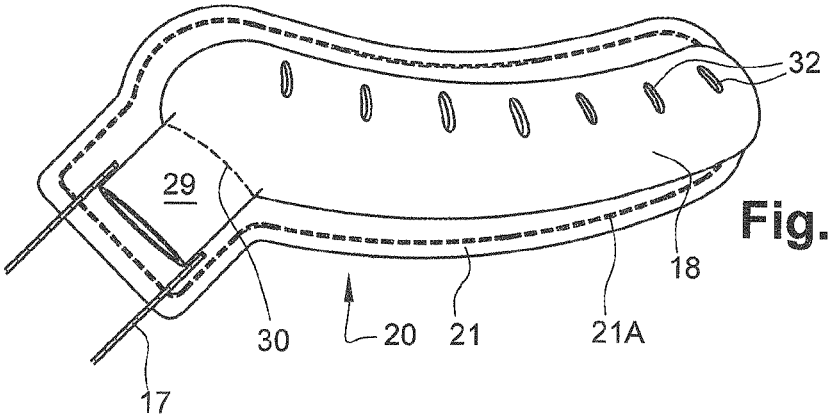
FIG. 13 represents an alternative of the second interface.

FIG. 13 illustrates a variant of the second interface 20, indeed the second interface 20 is presented in the form of a second longitudinal hollow body 18 having at least one series of air outlet orifices 32. This second longitudinal hollow body is equipped with an opening 30, possibly equipped with a tube 29, arranged to connect the means for directing 17 the surrounding air, possibly by means of an additional connector, and also comprises a collar 21 equipped with a peripheral groove 21A intended to house a sewing of the underclothing, preferably said second longitudinal hollow body is sewn on a torso cross-section, preferably a thorax cross-section, even collar, in any case, an under head cross-section of the underclothing of the user as illustrated in FIG. 16. In this representation, the second interface 20 by having a second longitudinal hollow body shape is particularly adapted to providing a surrounding airflow which is comfortable for the user, not draining their mucous membranes and by preserving the quality of air exchanges with the cleanroom.

Figure 14:
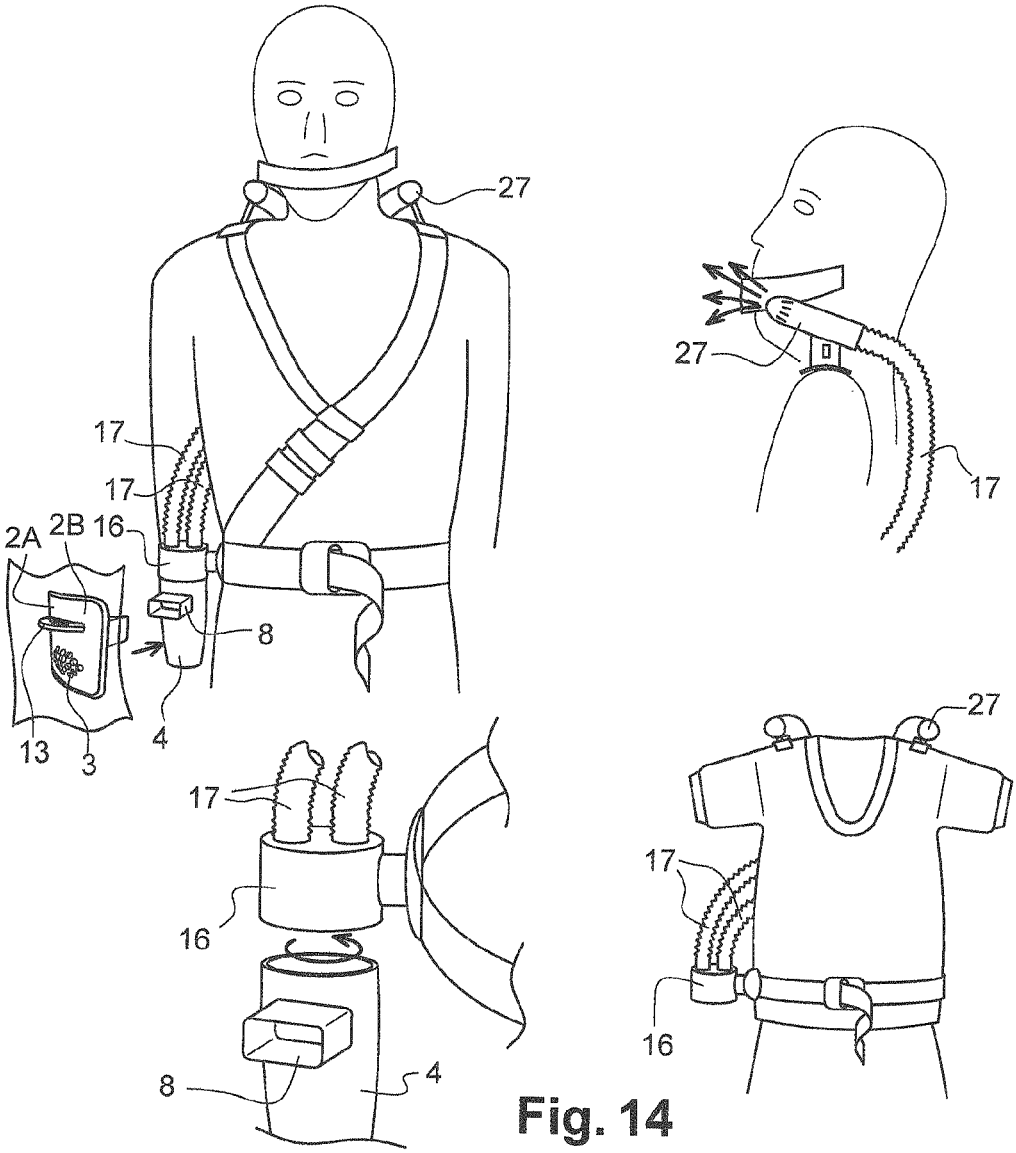
FIGS. 14 and 15 represent alternative of the fixing of the aeration device according to the invention to the underclothing of a user.
Figure 15:
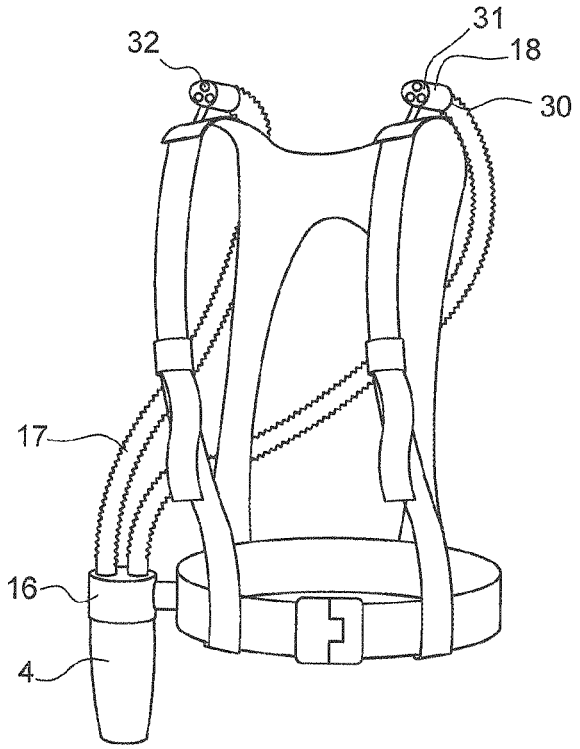

FIGS. 14 and 15 illustrate variants of the fixing of the aeration device 1 to the underclothing of a user, indeed, the aeration device 1 can be fixed, possibly by means of a connector 16, to a harness or to a backpack-type system that the user wears directly on themselves or wears, for example, on the underclothing. Furthermore, in these representations, the means for directing 17 the surrounding air is presented in the form of two tubes arranged to direct the surrounding air to the under head cross-section through their back. Indeed, the two tubes of the means for directing 17 the surrounding air will pass through the back of the user, and each of the two tubes will be connected to a part 27 making it possible for the diffusion of the surrounding air to the user for their breathing.

Indeed, the hollow body 18 is integral with the underclothing 23, for example fixed at the level of the shoulder of the underclothing 23. The hollow body 18 can also be integral with the means for directing 17 the surrounding air. Finally, the hollow body 18 can be presented in the form of a diffuser of the outlet of surrounding air in an inner portion of the aseptic overalls 24, this diffuser being equipped with an air outlet orifice 31, comprising at least one series of air outlet orifices 32.

Furthermore, the first air suctioning interface 2A is made of thermoplastic polyurethane and/or of nitrile group-based rubber, preferably made of butadiene-acrylonitrile copolymer.

It is well understood that the present invention is in no way limited to the embodiments described above and, that various modifications can be applied to it, without moving away from the scope of the appended claims.

For example, when the terms "orientation of the surrounding air of a cleanroom external to said aseptic overalls in an inner portion of said aseptic overalls" are used, this also means that the surrounding air of a cleanroom can be substituted by the breathable air coming from a compressed air cylinder, equipped for example with a pressure reducer, such as in situations where the air is contaminated.

For example, when the term "underclothing" is used, by extension this means that said underclothing can be a sublayer of the overalls.

For example, said air inlet means can be connected to the portable-type system for filtering the outside air, other than an aeration device.

The invention claimed is:

1. An active breathing system for an aseptic overalls arranged to be worn by a user comprising:

an aeration device to enable orientation of surrounding air of a cleanroom external to said aseptic overalls in an inner portion of said aseptic overalls, said aeration device being arranged to be located inside said aseptic overalls and comprises:

a first longitudinal hollow body arranged to receive a ventilator which is arranged to be connected to an energy source, a surrounding air suctioning tube in fluidic communication with said longitudinal hollow body, a surrounding air outlet in fluidic communication with said longitudinal hollow body, and arranged to direct the surrounding air upwards, an air inlet arranged to be situated on said aseptic overalls and arranged to enable passage of the surrounding air on the outside of said aseptic overalls in said inner portion of said aseptic overalls, the air inlet comprising a first air suctioning interface comprising a main wall arranged outside of said aseptic overalls, from which extends a lateral tube, arranged to extend through the aseptic overalls to an inside of said aseptic overalls and to be reversibly connected to said surrounding air suctioning tube, said main wall having at least one orifice equipped with a filtering membrane, arranged to enable passage of the surrounding air external to said aseptic overalls, in said lateral tube in a direction of the inside of said aseptic overalls, by sequential passage in said surrounding air suctioning tube, in said first longitudinal hollow body and through said surrounding air outlet, said air inlet supplying said surrounding air suctioning tube of said aeration device.

2. The system according to claim 1, comprising at least one means for directing the surrounding air, wherein said surrounding air outlet is connected to a first end of said at least one means for directing the surrounding air in an under head cross-section of said overalls.

3. The system according to claim 2, wherein said at least one means for directing the surrounding air comprises a tube connected at a first end to said surrounding air outlet, wherein said tube is a flexible tube, by a connector.

4. The system according to claim 3, wherein a second end of said at least one means for directing the surrounding air is arranged to be connected to a second interface present on an underclothing.

5. The system according to claim 3, further comprising an underclothing comprising at least one pushbutton, wherein said at least one means for directing the surrounding air is fixed to the underclothing in a shoulder area, using an additional material part arranged so as to form a loop maintaining an end of said at least one means for directing surrounding air against the underclothing, said loop or said additional material part being attached to the underclothing, by the at least one pushbutton.

6. The system according to claim 2, further comprising an underclothing comprising at least one pushbutton, wherein said at least one means for directing the surrounding air is fixed to the underclothing in a shoulder area, using an additional material part arranged so as to form a loop maintaining an end of said at least one means for directing surrounding air against the underclothing, said loop of said additional material part being attached to the underclothing, by the at least one pushbutton.

7. The system according to claim 1, further comprising an underclothing comprising at least one pushbutton.

8. The system according to claim 7, wherein a second interface is either fixed by said at least one pushbutton,. or said second interface is sewn on the underclothing and comprises a second hollow body equipped with a collar equipped with a peripheral groove for fixing to a material part of the underclothing, the second hollow body is capable of housing a sewing of the material part of the underclothing to said second interface if sewn on, said second hollow body being equipped with an orifice for connecting to a second end of said at least one means for directing the surrounding air, and at least one air outlet.

9. The system according to claim 8, wherein said aseptic overalls comprises an outer face provided to be in contact with a surrounding environment and an inner face arranged to be in contact with said user, a first leg cross-section and a second leg cross-section, an opening comprising a closer in a crotch area, along each first and second leg cross-sections, a first sleeve and a second sleeve and a body portion to which are connected the first and second sleeves by a linked end, the first and second leg cross-sections being connected to the body cross-section by a linked end, said body portion comprising a head passage cross-section.

10. The system according to claim 9, wherein said aseptic overalls further comprises at least one first grasping means, in contact with the inner face in the body portion.

11. The system according to claim 1, further comprising said aseptic overalls which is equipped with said first air suctioning interface, said first interface comprising a peripheral recess to house a sewing of the overalls to said first interface.

12. The system according to claim 1, wherein said first longitudinal hollow body has an open proximal end, said open proximal end being adjacent to said ventilator, and a closed distal end, said closed distal end being adjacent to said energy source.

13. The system according to claim 1, said first longitudinal hollow body having an outer wall and an inner wall, said outer wall being equipped with fixing means arranged for reversibly fixing of said longitudinal hollow body at the level of the hips of said user, said fixing means comprising a slider arranged for fixing to a belt of said user, provided on the underclothing when the belt is present.

14. The system according to claim 13, wherein said outer wall of said first longitudinal hollow body is equipped with a switch arranged to activate or stop said ventilator, said switch is a mechanical or electronic switch of which actuation is carried out by the connection of said air inlet to said surrounding air suctioning tube, or a pushbutton.

15. The system according to claim 1, wherein said first air suctioning interface is reversibly connected to said first longitudinal hollow body of said aeration device by a connecting element by a forced interlocking or by crimping.

16. The system according to claim 1, wherein said main wall of said first air suctioning interface is equipped with grasping means extending transversally with respect to said main wall.

17. The system according to claim 1, wherein said first air suctioning interface is made of thermoplastic polyurethane and/or of nitrile group-based rubber.

* * * * *